US005152260A

United States Patent [19]

Erickson et al.

[11] Patent Number: 5,152,260

[45] Date of Patent: Oct. 6, 1992

[54] HIGHLY EFFICIENT PNEUMATICALLY POWERED HYDRAULICALLY LATCHED ACTUATOR

[75] Inventors: Frederick L. Erickson; William E. Richeson, both of Fort Wayne, Ind.

[73] Assignee: North American Philips Corporation, New York, N.Y.

[21] Appl. No.: 680,494

[22] Filed: Apr. 4, 1991

[51] Int. Cl.[5] ..... F01L 9/02

[52] U.S. Cl. ..... 123/90.12; 123/90.14

[58] Field of Search ..... 123/90.12, 90.14

[56] References Cited

U.S. PATENT DOCUMENTS 5,058,538 10/1991 Erickson et al. ..... 128/90.12

*Primary Examiner*—Noah P. Kamen

[57] ABSTRACT

A high efficient actuator used to operate an engine's poppet valves is disclosed. Pneumatic pressure is applied to an actuator piston which is locked in either a first or a second position by an interconnected fluid latch. Upon a timed command, the piston latch is released allowing the pre-pressurized piston to rapidly transit from whichever of its two positions it happens to be in to the other. The actuator is configured to compress the air on the advancing side of the piston as the energy of the expanding air is propelling the piston to its other position. The fluid latch is configured to prevent the main piston from reversing direction at the end of its travel, thus trapping all the compressed air to be used to help propel the actuator piston back to its original position. The actuator has a feature for supplying make up air on the opening portion of the cycle in order to compensate for blow down as well as other losses. The actuator also has a feature for increasing the pressure in the latching chamber during the return stroke to assure positive seating of the interconnected poppet valve.

21 Claims, 7 Drawing Sheets

HIGHLY EFFICIENT PNEUMATICALLY POWERED HYDRAULICALLY LATCHED ACTUATOR

SUMMARY OF THE INVENTION

The present invention relates generally to two position straight line motion actuators as may, for example, but utilized to actuate the poppet valves of internal combustion engines and especially to such actuators which are bistable in their operation. More specifically, the present invention relates to a pneumatically powered, hydraulically latched actuator with stored pneumatic energy providing the propulsion force in each direction. The actuator is held in each of its stable positions by a hydraulic fluid exchange latch which applies a force in opposition to that of the stored pneumatic energy. The force of the fluid exchange latch is accentuated in one of the two stable positions by a pneumatic to hydraulic pressure conversion arrangement which tightens the grip of the hydraulic latch in that one position.

The prior art has recognized numerous advantages which might be achieved by replacing the conventional mechanical cam actuated valve arrangements in internal combustion engines with other types of valve opening mechanisms which could be controlled in their opening and closing as a function of engine speed as well as engine crankshaft angular position or other engine parameters.

For example, in U.S. patent application Ser. No. 226,418 entitled VEHICLE MANAGEMENT COMPUTER filed in the name of William E. Richeson on Jul. 29, 1988 there is disclosed a computer control system which receives a plurality of engine operation sensor inputs and in turn controls a plurality of engine operating parameters including ignition timing and the time in each cycle of the opening and closing of the intake and exhaust valves among other.

U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

U.S. Pat. No. 4,700,584 suggests that if freely adjustable opening and closing times for inlet and exhaust valves is available, then unthrottled load control is achievable by controlling exhaust gas retention within the cylinders.

Substitutes for or improvements on conventional cam actuated valves have long been a goal. In the Richeson U.S. Pat. No. 4,794,890 entitled ELECTROMAGNETIC VALVE ACTUATOR, there is disclosed a valve actuator which has permanent magnet latching at the open and closed positions. Electromagnetic replusion may be employed to cause the valve to move from one position to the other. Several damping and energy recovery schemes are also included.

In copending application Ser. No. 153,257, entitled PNEUMATIC ELECTRONIC VALVE ACTUATOR, filed Feb. 8, 1988 in the names of William E. Richeson and Frederick L. Erickson and assigned to the assignee of the present application there is disclosed a somewhat similar valve actuating device which employs a release type mechanical rather than a repulsion a scheme as in the previously identified U.S. Patent. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not.

The foregoing as well as a number of other related applications all assigned to the assignee of the present invention and filed in the name of Williams E. Richeson or William E. Richeson and Frederick L. Erickson are summarized in the introductory portions of copending Ser. No. 07/294,728 filed in the names of Richeson and Erickson on Jan. 6, 1989 and entitled ENHANCED EFFICIENCY VALVE ACTUATOR.

Many of the later filed above noted cases discloses a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by pneumatic force on the control valve when an electrical pulse to a coil near the permanent magnet neutralizes the attractive force of the magnet.

An electronically controlled pneumatically powered actuator as described in our U.S. Pat. No. 4,825,528 has demonstrated very rapid transit times and infinite precise controllability. Devices constructed in accordance with this patent are capable of obtaining optimum performance from an internal combustion engine due to their ability to open and then independently close the poppet valves at any selectable crank shaft angles. In this prior patented arrangement, a source of high pressure air is required for both opening and for closing the valves. Moreover, such devices require a certain amount of duplication of structure in that symmetrical propulsion, exhaust air release, and regulated latching pressure (damping air) arrangements are needed. In this prior art configuration, substantially the same volume of air must be used to close the valve as was required to open it.

In the devices of certain of these applications, air is compressed by piston motion to slow the piston (dampen piston motion) near the end of its stroke and then that air is abruptly vented to atmosphere. When the piston is slowed or damped, its kinetic energy is converted to some other form of energy and in cases such as dumping the air compressed during damping to atmosphere, that energy is simply lost. U.S. Pat. Nos. 4,883,025 and 4,831,973 discloses symmetric bistable actuators which attempt to recapture some of the piston kinetic energy as either stored compressed air or as a stressed mechanical spring which stored energy is subsequently used to power the piston on its return trip. In either of these patented devices, the energy storage device is symmetric and is releasing its energy to power the piston during the first half of each translation of the piston and is consuming piston kinetic energy during the second half of the same translation regardless of the direction of piston motion. More importantly, in each of these cases, there is a source of energy for propelling the piston in addition to the supplied by the energy storage scheme.

Our recent invention disclosed in U.S. Ser. No. 07/557,370, filed Jul. 24, 1990 entitled ACTUATOR WITH ENERGY RECOVERY RETURN propels an actuator piston from a valve-closed toward a valve-open position and utilizes the air which is compressed during the damping process to power the actuator back to its initial or valve-closed position. Moreover, an actuator capture or latching arrangement, such as a hydraulic latch, is used in this recent invention to assure that the actuator does not immediately rebound, but rather remains in the valve-open position until commanded to return to its initial position. The initial translation of the actuator piston in this recent application is powdered by pneumatic energy for an air pump and requires relatively large source pump as well as relatively large individual valve actuators.

Our recent invention as disclosed in U.S. Ser. No. 07/557,369 filed Jul. 24, 1990 and entitled HYDRAULICALLY PROPELLED PNEUMATICALLY RETURNED VALVE ACTUATOR takes advantage of many of the developments disclosed in the contemporaneously filed ACTUATOR WITH ENERGY RECOVERY RETURN application while the initial powered translation is accomplished by hydraulic energy from a hydraulic pump rather than by pneumatic energy. Hydraulic energy propulsion yields the advantages of reduced actuator size and, therefore, is easier to package, as well as a reduction of the size of and, therefor, the space required underneath a vehicle hood by the hydraulic pump. Also, in furtherance of the goal of reduction in size, the compression of latching air and pneumatic energy recovery feature is accomplished in a smaller chamber than taught in our ACTUATOR WITH ENERGY RECOVERY RETURN application. The reduction in size is accompanied by a correlative increase in peak pressure of the compressed air. The latching pressure must be corresponding increased, and in particular, a decrease in piston diameter to one-half the former value requires a corresponding four-fold increase in pressure to maintain the same overall latching force.

In our copending application entitled PNEUMATIC PRELOADED ACTUATOR, U.S. Pat. No. 5,109,812 filed on even date herewith, there is disclosed an actuator having hydraulic latching at each extreme of its motion with a pneumatic spring which is cocked as a piston nears the end of each of its traversals to subsequently power the piston back in the other direction. Supplementary power to make up for system losses such as friction is supplied by supplemental hydraulic pressure being valved in to the latching chamber near the end of piston travel in one direction.

In our copending application entitled SPRING DRIVEN HYDRAULIC ACTUATOR U.S. Pat. No. 5,125,371 filed on even data herewith, there is disclosed a compressed fluid spring concept for propelling an engine poppet valve back and forth which is structurally similar to the mechanical disclosed in Richeson U.S. Pat. No. 4,974,495, but where a timed delivery of supplemental pressure to a separate latching piston provides for fully re-cocking those springs in each direction preparatory to the next transition.

The entire disclosures of all of the above identified copending applications and patents are specifically incorporated herein by reference.

In the present invention, as in certain of our prior inventions, hydraulic latch locks the power piston in its second (engine valve open) position after that power piston has compressed a quantity of air in moving from its initial (engine valve seated) position. The present invention represents a significant departure from the prior art in using a modified latch to obtain the additional function of latching and pneumatic energy storage in the first or poppet valve closed position as well. This double latching feature requires a second set of control valves which operate in a second channel. Since almost all of the energy of compression which is captured during the initial transit can be used to power the actuator back to its initial position and most of the compression energy can also be captured by the second latch on the return stroke, this actuator design represents an improvement in theoretical efficiency over the other methods that have been disclosed. The permanent magnet latching schemes so common in many of our earlier applications have, as in the ACTUATOR WITH ENERGY RECOVERY RETURN and HYDRAULICALLY PROPELLED PNEUMATICALLY RETURNED VALVE ACTUATOR applications, been eliminated along with their associated cost and weight.

The present invention represents an advanced pneumatic actuator which is specifically configured to achieve a very high air usage efficiency. The methodology used to realize this includes powering the actuator in such a way that only a small quantity of thrusting air is lost during the first transit and to "catch" the piston with an automatic latch at the second position so that the energy of compression is used to stop the piston. On command, the latch is released to return the actuator piston to its first position. During the conversion of the kinetic energy to potential energy, using pneumatic means, the potential energy is contained in two parts; pressure-volume and temperature change-mass. The first is subject to leakage and the second is subject to a transfer of heat of the mass of gas in question which also affects the pressure of that gas. Both of these losses are a function of the time during which that the particular state is maintained. This possible variable loss can affect the kinetic energy during the next transfer taking place in the actuator and can also affect the damping at the terminal end of that transfer. Another feature of the invention is the introduction of a small quantity of supplemental air by way of a one way valve which is actuated by the power piston at the end of its travel. The valve will automatically add sufficient air to pre-pressurize the power piston to the working source pressure which stabilizes the damping and the succeeding propulsion energy. The piston is thus automatically pressurized and latched ready to being its next round trip transit when the "activate" signal is received. The only pneumatic energy used is represented by that quantity of air used to bring the pressure of the returning piston back up to source pressure. The valve also assures that the piston will always have the same potential energy available for the next transit since the valved-in working pressure assures a fixed pressure reference. Without this feature, a variable pressure (or energy) condition can exist due to leakage or due to the act that since the air is reheated as it is recompressed, the final compression pressure can vary due to differences in transfer of heat into the walls (the walls may be cold or may be hot) and also since the time of heat transfer can vary according to the speed of the engine. A further feature of the present invention is the incorporated of a design in which the power piston is directly connected to a double acting latch for the latching of the power piston in either of its extreme positions. This method of latching is intended to keep the piston from moving toward its other position rather then being a latch intended to simply pressurize and force the piston further into its present position. Therefore, this latch is designed to hold a power piston in a reverse direction similar to the concept described in U.S. Pat. No. 4,942,852 rather than to pressurize and force the piston in the opposite direction as described in U.S. Pat. No. 4,872,425.

Among the several objects of the present invention may be noted the provision of a bistable valve actuator of improved design and enhanced efficiency; the provision of a pneumatically driven, pneumatically returned valve actuator which is hydraulically latched in either of its extreme positions; the provision of a hydraulic capture arrangement for temporarily delaying the return of the valve from one of its valve-open and valve-closed positions to the other; the provision of a hydraulic latch for the armature of an actuator which, once the armature has been captured, unilaterally accentuates the force holding the armature in its captured position; the provision of a variable stroke pneumatically powered actuator; and the provision of a latching arrangement for an actuator which tends to capture and pull the actuator into one of its latched positions. These as well as other objects and advantageous features of the present invention will be in part apparent and in part pointed out hereinafter.

A further object of this invention is to provide a positive pressurization of the piston right before an actuation signal is received. This latch design is similar to the single hydraulic latch described in copending application Ser. No. 07/557,369 filed Jul. 24, 1990, however, the latch of the present application is designed as a double holding device to hold the power piston in each of its two extreme positions. It is therefore another object of the present invention to provide a dual latching capability in a single compact unit. Thus, the control method for actuating this actuator is simply the release of either one of the two latches by a timed signal.

Utilizing a pressurized piston which is held back by a latch as opposed to releasing, or turning on, a pressurized fluid to power the piston as in prior designs, the piston may experience some creep forward due to slight compliance in the latch. This means that during closing of the interconnected poppet valve, this forward motion tendency may prevent the poppet valve from making controlled contact with the valve seat. It is therefore yet another object of the present invention to incorporate a pneumatic arrangement for boosting the hydraulic pressure against the power piston to pull the poppet valve into its seat in a calibrated and controlled manner.

The forgoing as well as other objects and advantageous features of the present invention will be in part apparent and in part pointed out hereinafter.

In general, an electronically controllable pneumatically powered valve actuating mechanism includes a power piston reciprocable along an axis and adapted to be coupled to an internal combustion engine poppet valve. There is a pneumatic motive arrangement for moving the piston, thereby causing the engine valve to move in the direction of valve stem elongation between valve-closed and valve-open positions. There is also a pneumatic damping arrangement for compressing a volume of air and imparting a continuously increasing decelerating force as the engine valve approaches one of the valve-open and valve-closed positions. Solenoids are operable on command to utilizing the compressed volume of air to power the piston back to the other of the valve-open and valve-closed positions. There is a cylinder in which the power piston may reciprocate thereby defining a pair of variable volume chambers one each to either side of the power piston, the pneumatic motive arrangement comprising a first of said variable volume chambers and the pneumatic damping arrangement comprising a second of the variable volume chambers during engine valve motion from the valve-closed to the valve-open position and the pneumatic motive arrangement comprising the second of said variable volume chambers and the pneumatic damping arrangement comprising the first of the variable volume chambers during engine valve motion from the valve-open to the valve-closed position. A variable pressure inlet for presetting the pressure in the second of the variable volume chambers provides variation of the location of the valve-open position relative to the valve-closed position.

Also in general and in one form of the invention, an electrically controlled actuator for an internal combustion engine poppet valve, has an arrangement for assuring gentle yet positive engine valve closure which includes a reciprocable mechanism portion including a power piston and a latching piston movable together back and forth between initial and second positions and a pneumatic motive arrangement for moving the piston, thereby causing the engine valve to move in the direction of stem elongation between valve-closed and valve-open positions. A damping chamber in which air is compressed by the power piston during translation of the mechanism portion in one direction is also provided so that compression of the air slows the mechanism portion translation and stores energy for subsequent propulsion of the power piston in an opposite direction. There is also a pneumatic to hydraulic piston for converting the air pressure in the damping chamber to hydraulic pressure applied to the latching piston so that the piston is responsive to damping chamber air pressure to urge the reciprocable portion in the same direction as the piston is moving to compress that air.

Still further in general and in one form, a method of securing the armature of a bistable reciprocating armature actuator in one of its stable positions includes conversion of kinetic energy of armature motion in one direction to potential energy in the form of pressure in a compressible medium, transferring the compressible medium pressure to pressure in an incompressible medium, and applying the incompressible medium pressure to the armature in that same one direction.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be constructed as limiting the scope of the disclosure or the scope of the invention in any manner.

DESCRIPTION OF THE PREFERRED EMBODIMENT

Figure 1:
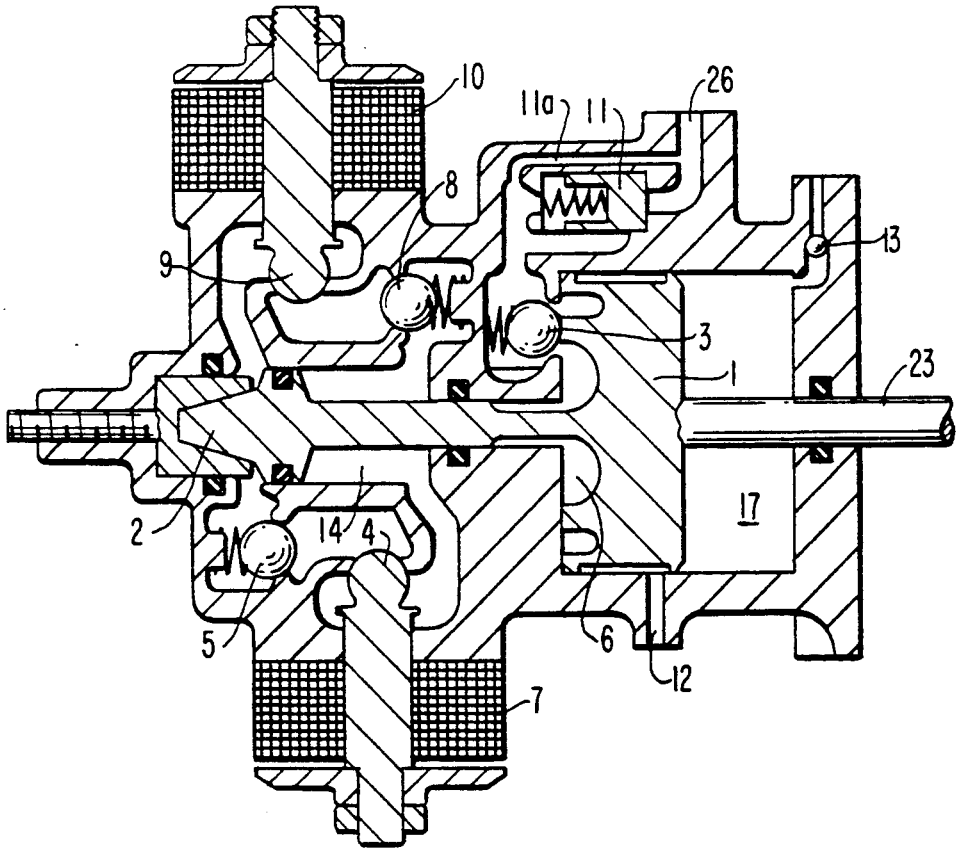
FIG. 1 is a view in cross-section of a pneumatically powered, hydraulically latched actuator in its initial at rest condition taken along lines 1—1 of FIG. 7.
Figure 2:
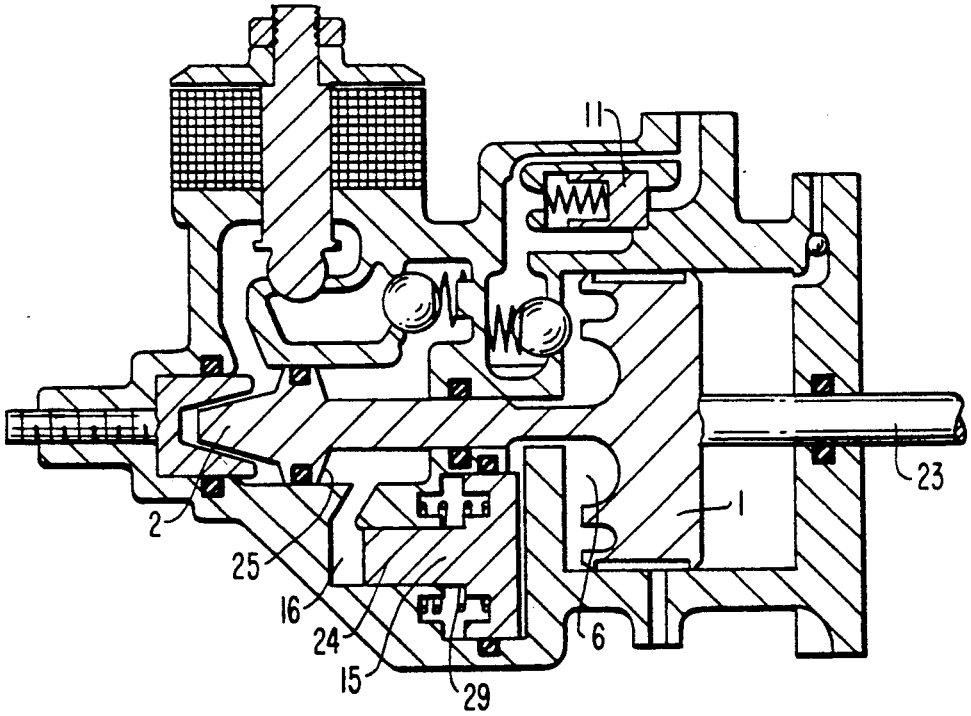
FIG. 2 is a view similar to FIG. 1, but illustrating the pressure boosting piston arrangement and taken along line 2—2 of FIG. 7.
Figure 3:
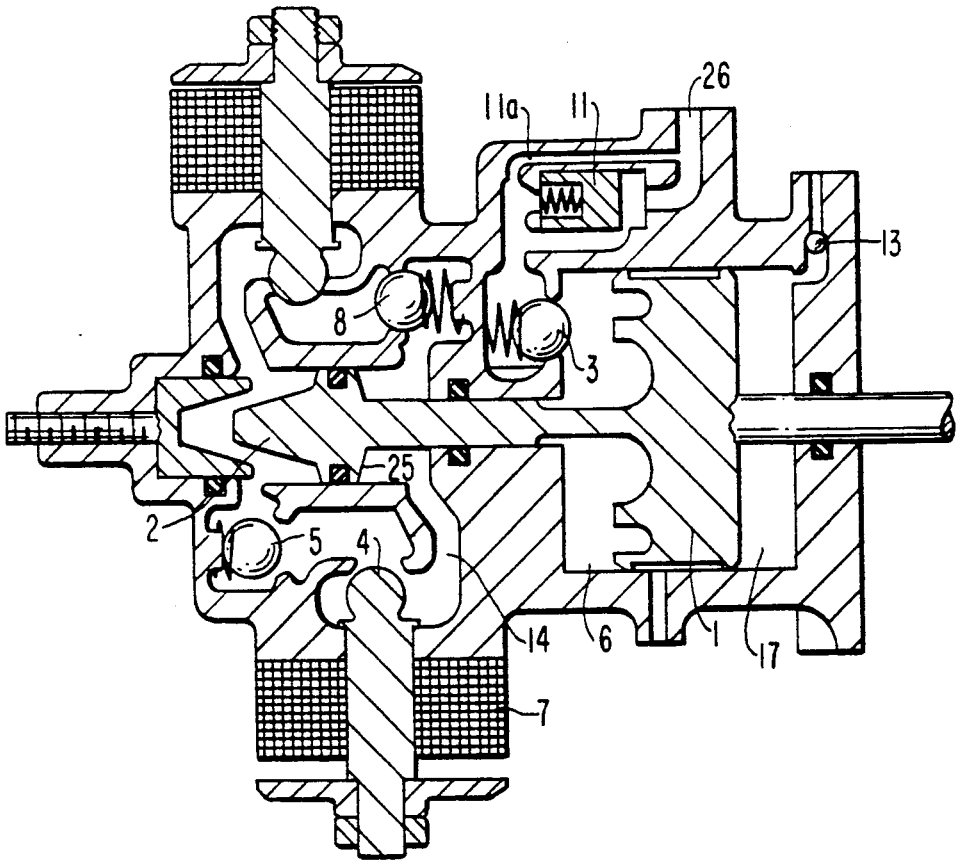
FIG. 3 is a view similar to FIG. 1, but with the power piston unlatched to begin its transit from its initial position to its second position.
Figure 4:
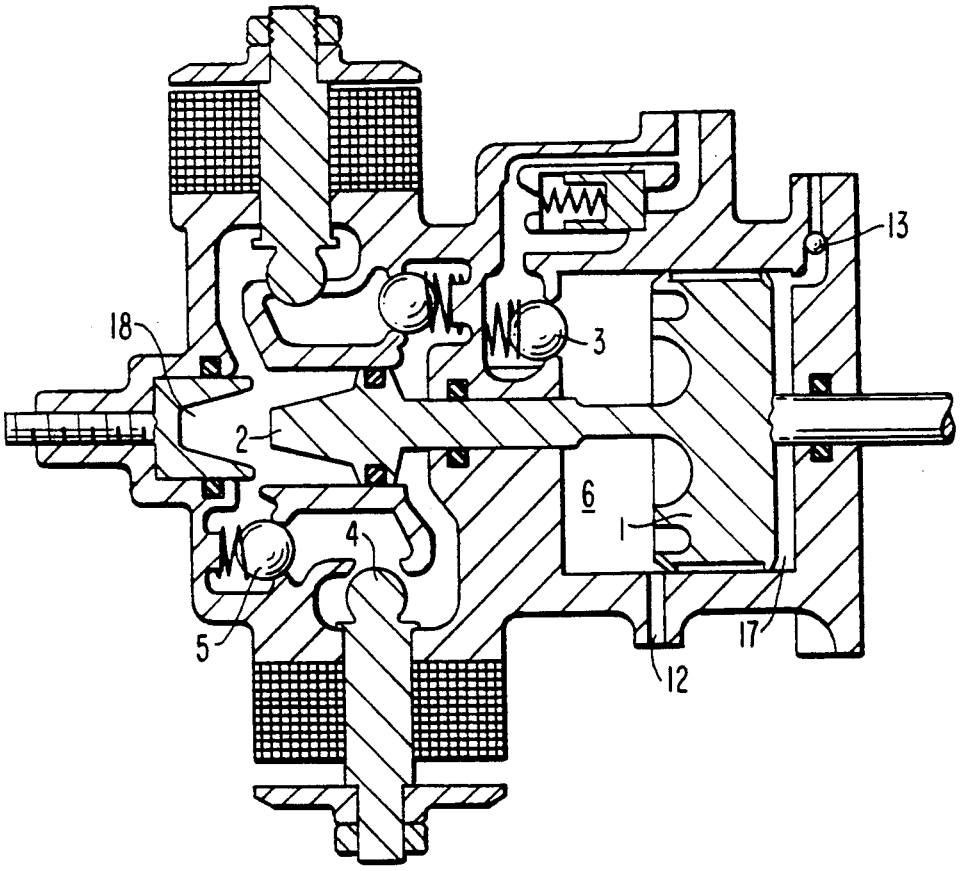
FIG. 4 is a view similar to FIGS. 1 and 3, but showing the actuator latched in its second position.
Figure 5:
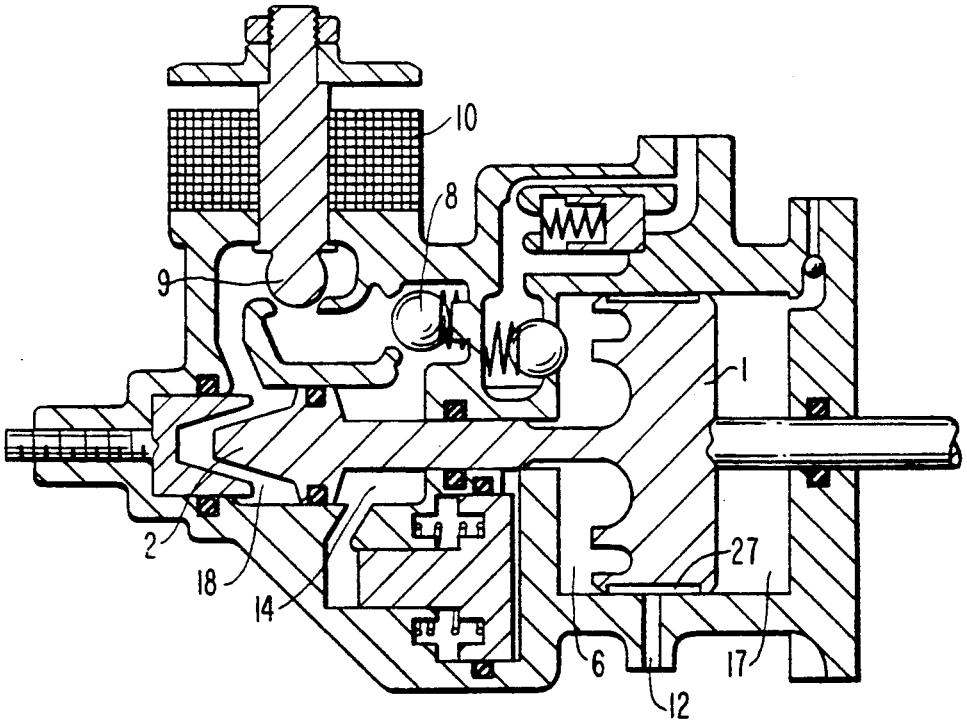
FIG. 5 is a view similar to FIGS. 2, but showing the actuator unlatched from its second position and compressing air on its return trip to the initial position.
Figure 6:
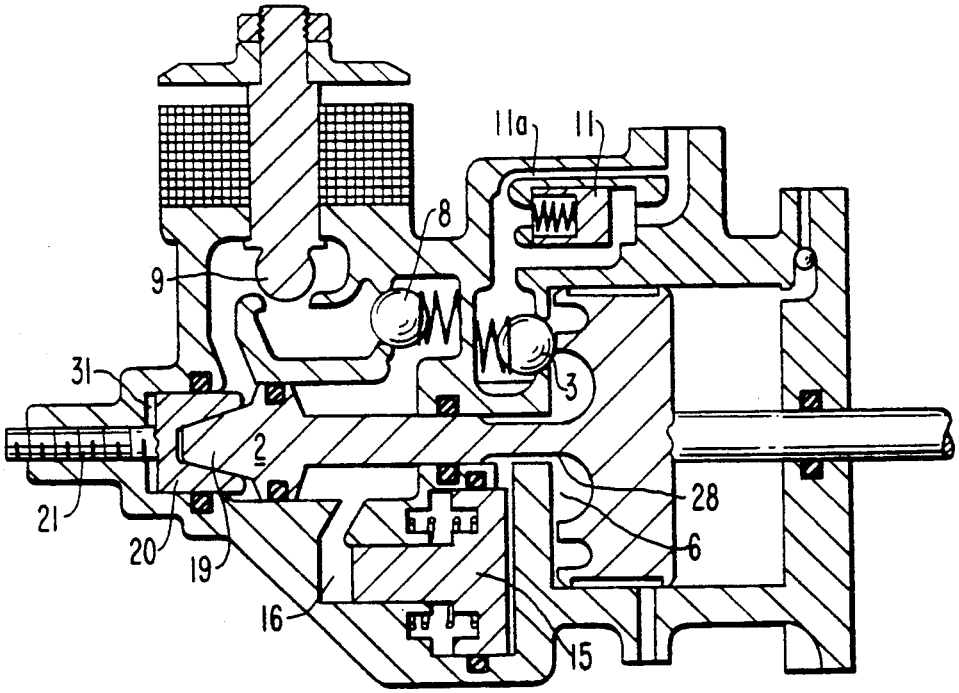
FIG. 6 is a view similar to FIGS. 2 and 5, but showing the actuator as it nears it initial position.
Figure 7:
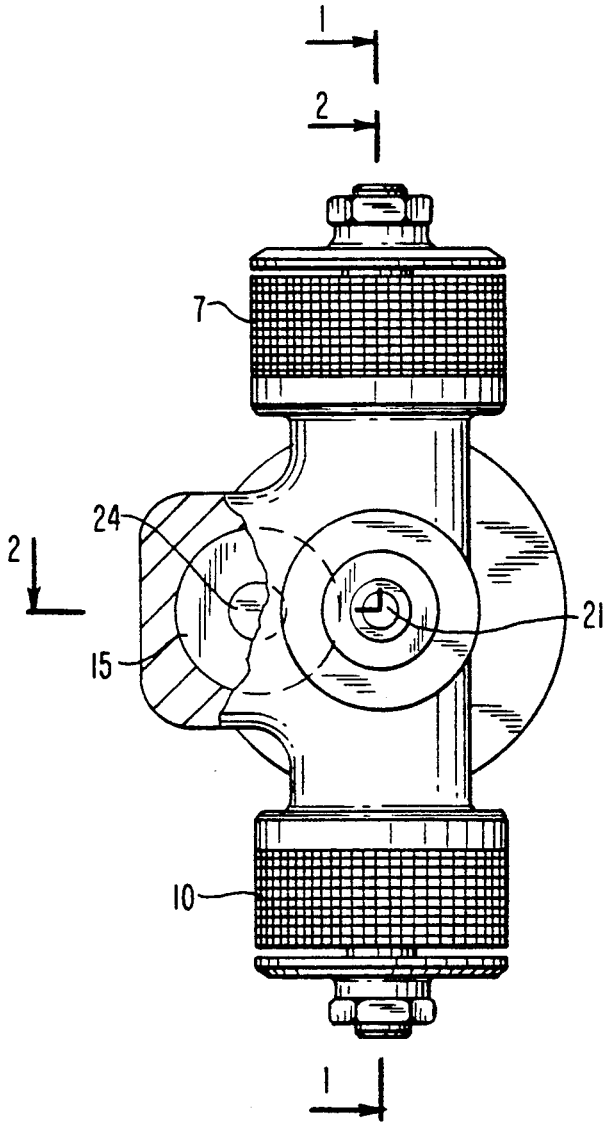
FIG. 7 is a partially broken away view from the left end of FIGS. 1-6.

Referring first to FIGS. 1-6 sequentially, the actuator is shown in its initial at rest condition in FIG. 1 in which prepressurization and delatching functions are shown. The initial position of FIG. 1 is the position where the engine poppet valve is seated or closed. FIG. 2 emphasizes the pressure boosting piston arrangement which increases the latching force over the pre-pressurization force. In FIG. 3, the power piston is delatched to begin its transit from initial to a second position. In FIG. 4, the actuator has reached that second position after compressing air ahead of the piston and is latched in that position. In FIG. 5, the actuator has been released from the second position and is compressing air as it returns to the initial position. In FIG. 6, the actuator is returning to its initial position as the power piston is being pre-pressurized and the latching piston is receiving boost pressure to pull the engine poppet valve into its seat.

The drawings generally illustrate a bistable pneumatically powered hydraulically latched actuator mechanism having a reciprocable portion including a power piston 1 and a latching piston 2 which are movable together back and forth between an initial position (FIG. 1) and a second position (FIG. 4). A source of high pressure air 26 replenishes are consumed during motion of the reciprocable portion of the mechanism. A damping chamber 6 is formed by the advancing face of piston 1 in which air is compressed slowing the mechanism portion translation and storing energy for subsequent propulsion of the power piston in an opposite direction. The latching piston 2 forms part of a hydraulic arrangement for temporarily preventing reversal of the direction of translation of the mechanism portion or armature (which includes shaft 23 along with pistons 1 and 2) when the motion of that portion slows to a stop. A solenoid 7 is operable on command to open ball valve 4, thereby disabling the temporary preventing arrangement, and freeing the portion of the mechanism to move under the urging of the air compressed in the damping chamber 6. A similar solenoid 10 opens ball valve 9 for the return of the engine valve to its closed or seated position. A pneumatic to hydraulic piston 15 (FIG. 2) converts the air pressure in the damping chamber 6 to hydraulic pressure in chamber 16 which is applied to the latching piston may be reciprocable portion more firmly into the valve seated position. the location of the second (engine valve open) position may be varied relative to the initial position. There is a second damping chamber 17 in which air is compressed by the power piston 1 during translation of the mechanism portion in the opposite, i.e., second or valve opening, direction. Compression of the air in chamber 17 slows the armature translation and stores energy for subsequent propulsion of the power piston back in the first direction. The initial air pressure in the second damping chamber 17 is established prior to translation which compresses the air in this chamber with that initial pressure determining the extent of translation in the second direction.

The hydraulic latch includes a hydraulic fluid filled cylinder within which the latching piston 2 reciprocates with the latching piston defining first and second fluid chambers 14 and 18 (FIG. 5) on its opposite sides. A first fluid transfer path from the first chamber 14 to the second chamber 18 includes a one-way check valve 5 for allowing fluid flow from the first chamber 14 to the second 18 while precluding fluid flow from the second chamber 18 to the first, and a controllable valve 4 normally preventing fluid flow from the first chamber 14 to the second chamber 18. Valve 4 is operable when actuated by solenoid 7 to allow fluid flow from the first chamber 14 to the second chamber 18. There is a second similar fluid transfer path from the second chamber to the first chamber including a one-way check valve 8 and a controllable valve 9 normally preventing fluid flow from the second chamber to the first chamber and operable when actuated to allow fluid flow from the second chamber to the first.

Referring now to FIG. 1 in greater detail, the actuator is shown in the first or engine valve closed position. The engine valve (not shown) is fixed to or actuated by axial motion of shaft 23. The actuator is "armed" with pressurized air in chamber 6 pushing on the left face of power piston 1. The interconnected latching piston 2 is holding the power piston from moving toward the right because the fluid in chamber 14 can not escape until the control valve 4 is opened. In this engine valve closed position, it is highly desirable to assure positive poppet valve seating particularly since the power piston is prepressurized in a direction which will tend to unseat the poppet valve. An additional arrangement to assure such positive poppet valve seating is provided in the form of a subpiston 15 shown in FIG. 2. The right hand face of subpiston 15 is pressurized by air in chamber 6 which is converted to hydraulic pressure in channel 16 by the reduced diameter piston portion 24. The subpiston functions to convert pneumatic pressure on its larger face to hydraulic pressure at its smaller face which acts on the right face 25 of piston 2 and is sufficiently high to counteract the pressure on power piston 1 and pull the shaft 23 toward the left and thereby pull the poppet valve into its seat. Subpiston 15 is reset to its rightmost position every cycle by spring 29. The ratio of the diameters of the two faces of the subpiston 15 establishes the magnitude of the latching pressure to assure that the force from the latching pressure is opposed to and the correct amount higher than the pneumatic pressure force on the power piston to establish the correct cinching force of the poppet valve onto its seat. The stroke of the subpiston 16 need not be particularly great, but should be sufficient to allow for any compressibility of the hydraulic fluid.

In particular, the function of the subpiston 15 is to convert the air pressure in chamber 6 to a hydraulic pressure boost in chamber 16. This increased hydraulic pressure will provide a higher force to the left on latching piston 2 than the source air pressure will apply to the right on the power piston 1. The net result is a force to the left which provides a positive seating of the engine poppet valve against its seat. Without this pressure boost, the valve may tend to drift open slightly, due to slight compressibility of the fluid in chamber 16 for example, and the engine valve may not properly seat. For this cinching force to occur at all, it is necessary that the ratio of the area of the larger (right hand) face to the area of the smaller face of subpiston 15 be greater than or equal to the ratio of the area of the advancing (left hand) face of Piston 1 to the area of the right hand face of latching piston 2.

FIG. 3, the conditions for triggering the actuator to begin its transit from the first to the second position are illustrated. The initial transit to open the engine poppet valve is initiated by opening the valve 4 to release the fluid in chamber 14 incident the face 25 allowing that fluid to flow through the one-way valve 5 and into the void in back of the rightwardly advancing latching piston 2. Opening valve 4 relieves the pressure on the latching piston 2 and allows the pressure of the expanding gas in chamber 6 on the left face of power piston 1 to drive that piston toward the right. In FIG. 3, the ball valve 3 has reseated to prevent any source air from high pressure source inlet 26 from entering the chamber 6. Delay valve 11 has, however, opened to re-fill the volume in back of the ball valve 3. As the piston 1 is being propelled by the expanding gas in chamber 6, it begins to compress the air in chamber 17 in front of the moving piston. The initial pressure in chamber 17 was set by an external pressure regulator through port 13. This pressure is adjustable in order to adjust the final compression volume and, hence, the total distance travelled by the piston 1. The greater the initial pressure in chamber 17, the less travel the piston experiences.

FIG. 4 shows the condition where the power piston has reached its second position or furthest location from its initial position. Several factors must be considered in determining the exact location of this position. The initial air pressure in chamber 6 is one factor, since the greater this pressure, the higher the force driving the piston to more highly compress the air in chamber 17. The pressure of the air at port 13 is a second factor. A higher initial pressure in chamber 17 will shorten the length of stroke the piston 1. In any case, the distance travelled corresponds to the point at which the magnitude of the compression energy equals the magnitude of the propulsion energy less any frictional and similar losses. In FIG. 4, the piston is automatically latched against any backward motion caused by the force of the compressed air in chamber 17. The pressurize of the hydraulic fluid in Chamber 18 holds latching piston 2 in its rightmost location. The actuator is armed and ready to be triggered for its return trip.

In FIG. 6, the actuator has been delatched or released from its second position to return to the initial position. This is initiated by opening the ball valve 9 to relative the pressure in chamber 18 and allow the hydraulic fluid to drain by way of one-way valve 8 back into chamber 14. FIG. 5 shows the piston 1 about midway along its path back to the engine valve closed position. The compressed air in chamber 17 has expanded and its potential energy has been converted back to kinetic energy of the power piston and its associated moving parts. Chamber 6 is rapidly decreasing in volume, compressing the air therein to slow and almost stop the piston as it nears its left extremity. The degree of damping provided by the compressed air in chamber 6 depends on the pressure applied to the chamber by way of port 12 at the time that port was closed by the seal 22 of piston 1.

In FIG. 6, the actuator has almost returned to its initial position. Valve 3 is just beginning to open to allow some source air to refill chamber 6. The undercut region 28 of shaft 23 has cleared to allow air from chamber 6 to pass and pressurize the larger face of subpiston 16. As the piston 1 fully unseats the ball valve 3, the air entry valve 11 which is used to introduce a pressurization delay is now open to allow full pressurization of chamber 6. The vale 11 is used to delay air entry so that initial damping of the power piston 1 can occur before the higher pressure is then used to provide pressure boost to the latch to cinch the poppet valve into its seat. A small feed line 11*a* bypasses the air entry valve 11 to assure that source pressure is always applied to the backside of ball valve 3.

FIG. 6 also illustrates a supplementary method of damping control in which the extension cone 19 of the latching piston 2 engages an internal conical receptacle 20 as the armature nears its initial (engine valve closed) position. A final slow down or damping occurs as a result of the two mating conical surfaces squeeze out hydraulic fluid at the very end of the motion. The internal cone member 20 threadedly engages the body of the actuator at 21 so that rotary adjustment of the axial location of cone 20 and a fine tuning of the final damping are possible. Such adjustment has taken place between FIGS. 5 and 6 where, in FIG. 6, a gap 31 first appears.

From the foregoing, it is now apparent that a novel bistable actuating arrangement has been displaced meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follows.

What is claimed is:

1. A bistable pneumatically powered hydraulically latched actuator mechanism comprising:

a reciprocable portion including a power piston and a latching piston movable together back and forth between initial and second positions;

a source of high pressure air for replenishing air consumed during motion of the reciprocable portion of the mechanism;

a damping chamber in which air is compressed by the power piston during translation of the mechanism portion in one direction, compression of the air slowing the mechanism portion translation and storing energy for subsequent propulsion of the power piston in an opposite direction; and hydraulic means including the latching piston for temporarily preventing reversal of the direction of translation of the mechanism portion when the motion of that portion slows to a stop.

2. The bistable pneumatically powered hydraulically latched actuator mechanism of claim 1 further comprising means operable on command to disable the temporarily preventing means freeing the portion of the mechanism to move under the urging of the air compressed in the damping chamber in a direction opposite said one direction.

3. The bistable pneumatically powered hydraulically latched actuator mechanism of claim 1 further comprising means responsive to damping chamber air pressure for urging the reciprocable portion in said one direction.

4. The bistable pneumatically powered hydraulically latched actuator mechanism of claim 3 wherein the means responsive to damping chamber air pressure comprises a pneumatic to hydraulic piston for converting the air pressure in the damping chamber to hydraulic pressure applied to the latching piston.

5. The bistable pneumatically powered hydraulically latched actuator mechanism of claim 1 further comprising means for varying the location of the second position relative to the initial position.

6. The bistable pneumatically powered hydraulically latched actuator mechanism of claim 5 wherein the means for varying comprises a second damping chamber in which air is compressed by the power piston during translation of the mechanism portion in said opposite direction, compression of the air slowing the mechanism portion translation and storing energy for subsequent propulsion of the power piston back in said one direction, and valving means for establishing access to a regulated air pressure in said second damping chamber prior to translation in the second direction which regulated pressure determines the extent of translation in the second direction.

7. The bistable pneumatically powered hydraulically latched actuator mechanism of claim 1 wherein the hydraulic means comprises;

a hydraulic fluid filled cylinder within which the latching piston reciprocates, the latching piston defining first and second fluid chambers on opposite sides thereof, a first fluid transfer path from the first chamber to the second chamber including a one-way check valve for allowing fluid flow from the first chamber to the second while precluding fluid flow from the second chamber to the first, and a controllable valve normally preventing fluid flow from the first chamber to the second chamber and operable when actuated to allow fluid flow from the first chamber to the second; and a second fluid transfer path from the second chamber to the first chamber including a one-way check valve for allowing fluid flow from the second chamber to the first while precluding fluid flow from the first chamber to the second, and a controllable valve normally preventing fluid flow from the second chamber to the first chamber and operable when actuated to allow fluid flow from the second chamber to the first.

8. An electronically controllable pneumatically powered valve actuating mechanism for use in an internal combustion engine of the type having engine intake and exhaust valves with elongated valve stems, the actuator comprising;

a power piston reciprocable along an axis and adapted to be coupled to an engine valve;

pneumatic motive means for moving the piston, thereby causing the engine valve to move in the direction of stem elongation between valve-closed and valve-open positions; and pneumatic damping means for compressing a volume of air and imparting a continuously increasing decelerating force as the engine valve approaches one of the valve-open and valve-closed positions; and means operable on command for utilizing the compressed volume of air to power the piston back to the other of the valve-open and valve-closed positions, 9. The electronically controllable pneumatically powered valve actuating mechanism of claim 8 further comprising means for varying the location of the valve-open position relative to the valve-closed position.

10. The electrically controllable pneumatically powered valve actuating mechanism of claim 9 further comprising a cylinder in which the power piston may reciprocate thereby defining a pair of variable volume chambers one each to either side of the power piston, the pneumatic motive means comprising a first of said variable volume chambers and the pneumatic damping means comprising a second of the variable volume chambers during engine valve motion from the valve-closed to the valve-open position and the pneumatic motive means comprising the second of said variable volume chambers and the pneumatic damping means comprising the first of the variable volume chambers during engine valve motion from the valve-open to the valve-closed position, the means for varying comprising a variable pressure inlet for presetting the pressure in the second of the variable volume chambers.

11. In an electronically controlled actuator for an internal combustion engine poppet valve, an arrangement for securing gentle yet positive engine valve closure comprising:

a reciprocable mechanism portion including a power piston and a latching piston movable together back and forth between initial and second positions;

pneumatic motive means for moving the piston, thereby causing the engine valve to move in the direction of stem elongation between valve-closed and valve-open positions;

a damping chamber in which air is compressed by the power piston during translation of the mechanism portion in one direction, compression of the air slowing the mechanism portion translation and storing energy for subsequent propulsion of the power piston in an opposite direction; and means responsive to damping chamber air pressure for urging the reciprocable portion in said one direction.

12. The bistable pneumatically powered hydraulically latched actuator mechanism of claim 11 wherein the means responsive to damping chamber air pressure comprises a pneumatic to hydraulic piston for converting the air pressure in the damping chamber to hydraulic pressure applied to the latching piston.

13. In a bistable reciprocating armature actuator, the method of securing the armature in one of its stable positions comprising:

converting kinetic energy of armature motion in one direction to potential energy in the form of pressure in a compressible medium;

transferring the compressible medium pressure to pressure in an incompressible medium; and applying the incompressible medium pressure to the armature in said one direction.

14. The method of claim 13 wherein the actuator armature includes a power piston and a latching piston movable together back and forth between initial and second stable positions, and a damping chamber in which air may be compressed by the power piston during translation of the mechanism portion in said one direction, compression of the air slowing the armature movement and storing energy for subsequent propulsion of the power piston in an opposite direction, the step of converting including compressing the air in the damping chamber.

15. The method of claim 13 wherein the actuator armature includes a power piston and a latching piston movable together back and forth between initial and second stable positions, and a hydraulic arrangement including the latching piston for temporarily preventing reversal of the direction of translation of the armature when the motion of the armature slows to a stop, the step of applying including increasing the force on the latching piston to secure the armature in the initial position.

16. The method of claim 15 wherein the latching piston reciprocates within a cylinder and defines therewith first and second fluid chambers on opposite sides of the latching piston, the method including the additional steps of establishing a fluid transfer path from the first chamber to the second chamber, selectively operating a control valve to allow fluid to flow from the first chamber to the second chamber, and precluding fluid flow from the second chamber to the first chamber.

17. A bistable actuator having a mechanism portion reciprocable between each of two-stable positions and comprising:

a replenishable source of high pressure hydraulic fluid;

means operable in each of the stable positions for temporarily preventing translation of the mechanism portion including a latching piston having a pair of opposed faces and positioned closely adjacent the source of high pressure fluid, and a control valve for selectively supplying high pressure fluid to one of the latching piston faces thereby preventing translation of the portion of the mechanism including the latching piston;

a first variable volume chamber in which air is compressed during translation of the mechanism portion in one direction, compression of the air slowing the mechanism portion translation in said one direction, said first variable volume chamber retaining the compressed air to drive the mechanism portion back in a direction opposite said one direction;

a second variable volume chamber in which air is compressed during translation of the mechanism portion in said opposite direction, compression of the air slowing the mechanism portion translation in said opposite direction, said second variable volume chamber retaining the compressed air to drive the mechanism portion back in said one direction; and a source of high pressure air for maintaining the minimum air pressure in the first and second variable chambers at least a predetermined level.

18. An electronically controllable valve actuating mechanism for use in an internal combustion engine of the type having engine intake and exhaust valves with elongated valve stems, the actuator having a pair of stable positions and comprising;

a power piston having a pair of opposed faces defining variable volume chambers, the power piston being reciprocable along an axis and adapted to be coupled to an engine valve;

resilient damping means including the power pistons for imparting a continuously increasing decelerating force as the engine valve approaches either of the valve-opening and valve-closed positions;

hydraulic means operable on command for holding the power piston and engine valve in each of the stable positions, and operable on command to allow the resilient damping means to power the piston back from either of the valve-open and valve-closed positions to the other position.

19. A bistable electronically controlled pneumatically driven hydraulically latched transducer having an armature reciprocable between first and second positions, hydraulic means for holding the armature in each of the first and second positions said hydraulic means including a bistable control valve operable in one of its stable states to supply high pressure hydraulic fluid to force the armature in one direction and in the other of its stable states to supply high pressure hydraulic fluid to force the armature in an opposite direction, a first chamber in which air is compressed during motion of the armature from the first position to the second position, compression of the air slowing armature motion as it nears the second position, a second chamber in which air compressed during motion of the armature from the second position to the first position, compression of the air slowing armature motion as it nears the first position, the control valve remaining in said one stable state to temporarily prevent reversal of armature motion when the motion of the armature has slowed to a stop, the control valve returning to the other of its stable states on command to allow the air compressed in the chamber to return the armature to the first position.

20. A bistable electronically controlled transducer having an armature reciprocable between first and second positions, first pneumatic means for powering the armature from the first position to the second position, second pneumatic means for powering the armature from the second position back to the first position, a first pneumatic spring which is compressed during motion of the armature from the first position to the second position, compression of the first pneumatic spring slowing armature motion as it nears the second position, hydraulic means maintaining pressure on the armature to temporarily prevent reversal of armature motion when the motion of the armature has slowed to a stop, the hydraulic means being disableable on command to allow the compressed first pneumatic spring to return the armature to the first position.

21. A bistable electronically controlled transducer having an armature reciprocable between first and second positions, first means for powering the armature from the first position to the second position, second means for powering the armature from the second position back to the first position, at leas tone pneumatic spring which is compressed during motion of the armature from the first position to the second position with compression of the pneumatic spring slowing armature motion as it nears the second position, means for maintaining pressure on the armature to temporarily prevent reversal of armature motion when the motion of the armature has slowed to a stop and operable on command to allow the compressed pneumatic spring to return the armature to the first position, and means for establishing an initial air pressure for the pneumatic spring preparatory to compression during armature motion.

* * * * *